US010179261B2

(12) United States Patent
Licklider

(10) Patent No.: US 10,179,261 B2
(45) Date of Patent: Jan. 15, 2019

(54) STANDING STEP TRAINER

(71) Applicant: Better Standing Co., Inc., Framingham, MA (US)

(72) Inventor: Lawrence John Licklider, Waban, MA (US)

(73) Assignee: BETTER STANDING COMPANY, INC., Framingham, MA (US)

( * ) Notice: Subject to any disclaimer, the term of this patent is extended or adjusted under 35 U.S.C. 154(b) by 169 days.

(21) Appl. No.: 15/123,738

(22) PCT Filed: Oct. 21, 2015

(86) PCT No.: PCT/US2015/056788
§ 371 (c)(1),
(2) Date: Sep. 6, 2016

(87) PCT Pub. No.: WO2016/160066
PCT Pub. Date: Oct. 6, 2016

(65) Prior Publication Data

US 2017/0072257 A1 Mar. 16, 2017

Related U.S. Application Data

(60) Provisional application No. 62/142,567, filed on Apr. 3, 2015, provisional application No. 62/174,212, filed on Jun. 11, 2015.

(51) Int. Cl.
*A63B 22/16* (2006.01)
*A63B 5/08* (2006.01)
(Continued)

(52) U.S. Cl.
CPC ..... *A63B 22/16* (2013.01); *A61H 1/003* (2013.01); *A61H 1/005* (2013.01); *A61H 39/007* (2013.01);
(Continued)

(58) Field of Classification Search
CPC ..... A63B 22/16; A63B 21/0023; A63B 21/00069; A63B 21/05; A63B 21/00178;
(Continued)

(56) References Cited

U.S. PATENT DOCUMENTS 1,210,920 A * 1/1917 Fletcher ..... A63B 5/10 16/404
2,024,028 A * 12/1935 Dahlberg ..... A63B 5/10 267/173
(Continued)

FOREIGN PATENT DOCUMENTS

DE 8223548 12/1982
EP 0086274 6/1986

OTHER PUBLICATIONS

Neibauer, Josef, M.D. and Cooke, John P. M.D., 'Cardiovascular Effects of Exercise: Role of Endothelial Shear Stress', Journal of the American College of Cardiology, vol. 28, No. 7 (Dec. 1996), pp. 1652-1660.
(Continued)

*Primary Examiner* — Andrew S Lo

(57) ABSTRACT

The standing step trainer is a device that allows a user to engage in movement that is similar to walking, although less strenuous. The standing step trainer assists users in raising their center of mass after it has been lowered via plantar flexion, ankle flexion, dorsiflexion, and knee flexion. Because users receive an assist in returning to an upright, neutral standing position, they are able to move on the standing step trainer for extended periods of time. This type of movement has been shown to provide myriad health benefits including an increase in the flow of nitric oxide throughout the blood. The methods of the present invention disclose using the standing step trainer to attain these and many other health benefits while working at a desk, watch-
(Continued)

ing television, attending class, or any other activity that has heretofore been done from a sitting or standing position.

18 Claims, 5 Drawing Sheets

(51) Int. Cl.

| | |
|---|---|
| ***A61H 1/00*** | (2006.01) |
| ***A61H 39/00*** | (2006.01) |
| ***A63B 21/002*** | (2006.01) |
| ***A63B 21/02*** | (2006.01) |
| ***A63B 21/05*** | (2006.01) |
| ***A63B 21/00*** | (2006.01) |

(52) U.S. Cl.
CPC ..... *A63B 5/08* (2013.01); *A63B 21/0023* (2013.01); *A63B 21/00069* (2013.01); *A63B 21/00178* (2013.01); *A63B 21/023* (2013.01); *A63B 21/05* (2013.01); *A61H 2201/0165* (2013.01); *A61H 2201/1284* (2013.01)

(58) Field of Classification Search
CPC ..... A63B 21/023; A63B 5/08; A63B 2208/12; A63B 5/11; A63B 21/4047; A63B 22/0056; A63B 2022/0038; A63B 2071/0063; A61H 1/003; A61H 1/005; A61H 39/007; A61H 2201/0165; A61H 2201/1284
USPC ..... 482/30–32
See application file for complete search history.

(56) References Cited

U.S. PATENT DOCUMENTS

| | | | | |
|---|---|---|---|---|
| 2,764,413 | A * | 9/1956 | Wisner | A63B 5/10 482/31 |
| 2,996,295 | A * | 8/1961 | Smith | A63B 5/10 24/567 |
| 3,497,217 | A * | 2/1970 | Feather | A63B 23/025 482/10 |
| 3,856,296 | A * | 12/1974 | Fischer | A63B 5/10 482/31 |
| 4,341,380 | A * | 7/1982 | Sauder | A61H 1/0237 482/26 |
| 5,209,709 | A * | 5/1993 | Eyman, Jr. | A63B 5/08 482/26 |
| 5,352,173 | A * | 10/1994 | McLaughlin | A63B 23/03575 482/121 |
| 5,370,591 | A * | 12/1994 | Jewell | A63B 5/08 482/26 |
| 5,565,003 | A | 10/1996 | Gerstung et al. | |
| 5,634,870 | A * | 6/1997 | Wilkinson | A63B 5/11 482/27 |
| 6,155,976 | A | 12/2000 | Sackner | |
| 6,569,213 | B1 | 5/2003 | Busch | |
| 6,705,975 | B2 * | 3/2004 | Kuo | A63B 22/0056 482/51 |
| 6,716,144 | B1 * | 4/2004 | Shifferaw | A63B 21/023 297/161 |
| 7,090,648 | B2 | 8/2006 | Sackner et al. | |
| 7,111,346 | B2 | 9/2006 | Inman et al. | |
| 7,175,567 | B2 * | 2/2007 | Barbafieri | A63B 5/08 482/30 |
| 7,404,221 | B2 | 7/2008 | Sackner | |
| 7,438,696 | B2 | 10/2008 | Koonar | |
| 7,481,739 | B2 * | 1/2009 | Takizawa | A61H 1/0259 482/70 |
| 7,993,244 | B2 * | 8/2011 | Weller | A63B 5/08 482/23 |
| 8,622,747 | B2 | 1/2014 | Chu et al. | |
| 9,446,276 | B2 * | 9/2016 | Araujo | A63B 21/00181 |
| 2004/0235620 | A1 * | 11/2004 | Barbafieri | A63B 5/08 482/31 |
| 2005/0164836 | A1 * | 7/2005 | Harker | A63B 21/023 482/52 |
| 2008/0228110 | A1 * | 9/2008 | Berme | A61B 5/4023 600/595 |
| 2014/0038797 | A1 * | 2/2014 | Curry | A63B 21/023 482/142 |

OTHER PUBLICATIONS

Goldring, Deborah, 'Acceleration Therapeutics' AT-101 Provides Symptomatic Relief in Fibromyalgia & Chronic Fatigue Syndrome, Business Wire, (Published Jun. 23, 2004) [online], [retrieved on Feb. 2, 2017]. Retrieved from the Internet <URL: http://www.businesswire.com/news/home/20040623005569/en/Acceleration-Therapeutics-AT-101-Symptomatic-Relief-Fibromyalgia-Chronic#.VeuLDbT5MUU>.

Thosar, Saurabh S., Johnson, Blair D., Johnston, Jeanne D., Wallace, Janet P., 'Sitting and endothelial dysfunction: The role of shear stress,' Medical Science Monitor, (2012), 18(12), pp. RA173-RA180.

Arkady, Uryash, Wu, Heng, Bassuk, Jorge, Kurlansky, Paul, Sackner, Marvin A., and Adams, Jose A., 'Low-amplitude pulses to the circulation through periodic acceleration induces endothelial-dependent vasodilatation', Journal of Applied Physiology 106, (Mar. 26, 2009), pp. 1840-1847.

Potente, Michael and Dimmeler, Stefanie, 'NO Targets SIRT1: A Novel Signaling Network in Endothelial Senescence', Arteriosclerosis, Thrombosis and Vascular Biology (2008), 28, pp. 1577-1579 [retrieved on Feb. 2, 2017]. Retrieved from the Internet <URL: http://atvb.ahajournals.org>.

Valerio, Alessandra and Nisoli Enzo, 'Nitic oxide, interorganelle communication, and energy flow: a novel route to slow aging', Frontiers in Cell and Developmental Biology, (Feb. 6, 2015), vol. 3, Article 6, pp. 1-11.

Nyberg, Michael, Blackwell, James R., Damsgaard, Rasmus, Jones, Andrew M., Hellsten, Ylva and Mortensen, Stefan P., 'Lifelong physical activity prevents age-related reduction in arterial and skeletal muscle nitric oxide bioavailability in humans', The Journal of Physiology 590.21 (2012), pp. 5361-5370.

Loram, Ian D., Maganaris, Constantinos N. and Lakie, Martin, 'Human postural sway results from frequent, ballistic bias impulses by soleus and gastrocnemius', The Journal of Physiology 564.1 (2005), pp. 295-311.

Stromberg, Joseph, 'Five Health Benefits of Standing Desks', Smithsonian.com, (Published Mar. 26, 2014), [online], [retrieved on Feb. 2, 2017]. Retrieved from the Internet <URL: http://www.smithsonianmag.com/science-nature/five-health-benefits-standing-desks-180950259/?/no-ist>.

'Sodium nitroprusside', Wikipedia, [online], [retrieved on Feb. 3, 2017]. Retrieved from the Internet <URL: https://en.wikipedia.org/wiki/Sodium_nitroprusside>.

International Search Report from International Application No. PCT/US15/56788 dated May 17, 2016 (2 pages).

Written Opinion of the International Searching Authority from International Application No. PCT/US15/56788 dated May 17, 2016 (6 pages).

Machine-Translation: English Translation of Description of DE8223548, dated Apr. 19, 2016 (3 pages).

Machine-Translation: English Translation of Description of EP0086274, dated Apr. 28, 2016 (4 pages).

International Preliminary Examination Report on Patentability from International Application No. PCT/US2015/056788 dated Oct. 12, 2017 (8 pages).

* cited by examiner

STANDING STEP TRAINER

CROSS-REFERENCE TO RELATED APPLICATIONS

This application claims priority to the following U.S. Provisional Patent Applications: Provisional Patent Application No. 62/142,567, entitled "Apparatus to Assist Knee Bending and Straightening to Repeatedly Lower and Raise Body Center of Mass of a Standing Human Subject," filed on Apr. 3, 2015; and U.S. Provisional Patent Application No. 62/174,212, entitled "Apparatus to Assist Knee Bending and Straightening to Repeatedly Lower and Raise Body Center of Mass of a Standing Person," filed on Jun. 11, 2015, the entire contents of which are hereby incorporated by reference.

FIELD

The present invention relates generally to an apparatus for and methods of increasing the flow of nitric oxide in humans by using a standing step trainer, which aids an individual in upward and downward movements of the individual's center of mass after his or her center of mass has shifted.

BACKGROUND

In modern society, there is a plethora of devices designed to increase human physical activity levels. It is well known, that obesity rates have been steadily on the rise worldwide, while concurrently, the average time that people spend in sedentary pursuits, e.g., sitting at a desk, watching television, and working on a computer have likewise been increasing. In terms of combatting obesity, and the loss of overall health and fitness generally, there are myriad exercise devices, sporting equipment, training devices, vibrational platforms, and the like that are available in the market. A common theme among this disparate collection of devices is—movement, that is, getting the body moving improves health.

In terms of exercise equipment—treadmills, elliptical trainers, stationary bicycles, miniature trampolines, stationary cross country ski devices, stationary skating surfaces, are but a few of the types of devices that individuals have been using for many years to engage in cardiovascular exercise. "The notion that regular aerobic exercise reduces cardiovascular morbidity and mortality in the general population as well as in patients with coronary artery disease is strongly supported by evidence derived from epidemiologic studies. Physically active people also experience fewer clinical manifestations of coronary artery disease than do less active men and women. By contrast, sedentary life-style has been identified as a risk factor for development of coronary artery disease, and there is a strong correlation between physical inactivity and cardiovascular mortality." Niebaur, Josef, MD and Cooke, John P. MD., *Cardiovascular Effects of Exercise: Role of Endothelial Shear Stress* , JACC Vol. 28, No. 7, 1652, 1652 (December 1996), the entire contents of which are hereby incorporated by reference.

Toward this end, there has been an increased number of individuals choosing to work at standing desks as a way to reduce the amount of time they are seated at a desk. In a Mar. 26, 2014 article, Smithsonian.com wrote "There was a time when standing desks were a curiosity—used by eccentrics like Hemingway, Dickens and Kierkegaard, but seldom seen inside a regular office setting. That's changed, in large part due to research showing that the cumulative impact of sitting all day for years is associated with a range of health problems, from obesity to diabetes to cancer. Because the average office worker spends 5 hours 41 minutes sitting each day at his or her desk, some describe the problem with a pithy new phrase that's undeniably catchy, if somewhat exaggerated: 'Sitting is the new smoking'" http://www-.smithsonianmag.com/science-nature/five-health-benefits-standing-desks-180950259/?no-ist The Smithsonian article goes on to cite medical evidence that shows that standing desks lower mortality rate and reduce the risk of: (1) obesity; (2) Type 2 diabetes and other metabolic problems; (3) cardiovascular disease; and (4) cancer. Id.

Along with the increase in popularity of standing desks, there has also been an increase in accessories that accompany standing desks, such as anti-fatigue mats or exercise devices that can be paired with a standing desk. Anti-fatigue mats provide support for an individual's feet, while relieving pressure on the heels, back, legs, and shoulders, which in turn helps the person stand for longer. While an anti-fatigue mat can decrease the amount of overall body discomfort experienced by an individual while standing without walking or otherwise moving for extended periods of time, the individual will still experience foot, heel, back, leg, and shoulder pressure as the amount of time at the standing desk increases. This is because anti-fatigue mats provide cushioning that conforms to a wider area of an individual's foot surface, thereby spreading the application of forces across a person's foot. Although this cushioning allows individuals to stand longer, cushioning is not an obvious means of relieving pressure on the back, legs and shoulders.

An alternative to using an anti-fatigue mat is to pair a standing desk with an exercise device. Some standing desks come with a built-in treadmill. Stand-alone treadmills, elliptical machines, and stationary bicycles are also currently available to be paired with a standing desk. Although these exercise devices allow an individual to move, thereby assisting return of venous blood and lymph fluids from the feet and lower legs to the heart. Many users may find it too physically challenging to walk on a treadmill, ride a stationary bike, or pedal an elliptical trainer while simultaneously concentrating on the work they have before them.

Most people require a significant amount of training before they can simultaneously balance, move, and perform intellectual tasks. Moreover, some of these exercise devices are heavy and bulky and therefore do not lend themselves to being transported to an alternate working space if an individual is traveling outside of his or her ordinary office space. Additionally, some users may find that the amount of physical effort required to walk on a treadmill or pedal a bike or elliptical trainer distracts from their ability to concentrate on the work that they have to get done. Furthermore, if the physical effort is too great, individuals may begin to perspire, which could be undesirable at work.

Turning to a different type of movement—it is known that whole body physical acceleration increases the production of the circulatory mediator nitric oxide. Several inventors and doctors have published material describing the beneficial effects of whole body physical acceleration. For example, U.S. Pat. No. 7,438,696 to Koonar entitled "Physical Therapy Platform Assembly," the entire contents of which are hereby incorporated by reference, discussed how astronauts used a vibratory platform, which caused their muscles to contract in response to the vibrations, as a means of retaining muscle strength while spending extended periods of time in space. U.S. Pat. No. 7,438,696, Col. 1:16-31.

While this type of vibratory platform may be beneficial for the highly unique circumstances of weightlessness, most people experience discomfort caused by the unnatural and unhealthy forces, such as the feeling of having their eye balls rattling within their heads, when using the vibratory platforms. This discomfort is not necessary for individuals living on earth because physical acceleration under gravity induces forces on fluids and on particles borne within body's vessels that are necessary for signal transduction responsible for increasing enzymatic production of nitric oxide. The nitric oxide produced therefrom influences many outcomes in muscle tissues, especially as a result of subsequent increases in fluid volumes moving through vessels as a consequence of nitric oxide-mediated dilatation of vessels.

In U.S. Pat. No. 7,404,221 to Sackner, entitled "Reciprocating Movement Platform for the External Addition of Pulses to the Fluid Channels of a Subject," ("'221 patent") the entire contents of which are hereby incorporated by reference, Dr. Sackner noted that "[p]eriodic acceleration through nitric oxide release from activation of eNOS suppresses activity of nuclear factor kappa beta. This was recently demonstrated in a sheep model of asthma, which is an example of a nuclear factor kappa beta disease. Periodic acceleration (pGZ) stimulates NO release from endothelial nitric oxide synthase (eNOS) through pulsatile shear stress." '221 patent, Col. 13:4-10. The process that leads to dilation of vessels can also alter activities of cell surface signaling proteins, as given by the example of nuclear factor kappa beta.

"This is important because large amounts of nitric oxide are released after strenuous exercise in professional football players and other athletes that are associated with severe muscle cramps. Therefore, periodic acceleration can mitigate skeletal muscular cramps during an athletic event, and help to prevent muscle strains during an event as well as delayed onset muscular soreness (DOMS) and involuntary muscle cramps and spasms immediately following the athletic event and delayed until the sleeping hours. It has been found that an additional periodic acceleration treatment administered four to eight hours after the athletic event provides even better relief than a single pretreatment in relieving nocturnal muscle cramps." '221 patent, Col. 19:39:51.

"Activation of eNOS to release small quantities of nitric oxide preconditions the heart against the adverse effects of compromise of the blood supply to the heart that produces myocardial damage. Periodic acceleration activates eNOS through increased pulsatile shear stress and, as such, is means to precondition the heart." '221 patent, Col. 20:11-16.

"Based upon animal experiments, upregulation of endothelial nitric oxide synthase activity should increase the number of mitochondria present in skeletal muscle cells. In turn, heat production is increased within these cells thereby improving sports performances." '221 patent, Col. 20:30-34.

"Since many athletic venues do not permit effective drugs for the treatment of asthma because of [sic] they also improve performance unrelated to alleviation of asthma, pretreatment of such athletes can be accomplished with periodic acceleration to prevent exercise induced asthma. Here, the beneficial agent, nitric oxide is generated from the athlete's own body. Physical activity protects against ischemic stroke via mechanisms related to the upregulation of endothelial nitric oxide synthase (eNOS) in the vasculature. In wild-type mice that performed voluntary training on running wheels or exercise on a treadmill apparatus for 3 weeks, respectively, ligation of the middle cerebral artery was associated with reduced cerebral infarct size and functional deficits, improved endothelium-dependent vasorelaxation, and augmented cerebral blood flow. The neuroprotective effects of physical training were completely absent in eNOS-deficient mice, indicating that the enhanced eNOS activity by physical training was the predominant mechanism by which this modality protects against cerebral injury." '221 patent, Col. 20:46-65.

"In summary, periodic acceleration treatments administered prior to an athletic event minimize delayed onset of muscle soreness (DOMS) and nocturnal muscle spasms. An additional periodic acceleration treatment administered four to eight hours following cessation of the athletic event provides even further relief. Periodic acceleration administered prior to strenuous athletic events minimizes microscopic myocardial damage. Chronic treatment with periodic acceleration improves sports performance by promoting mitochondrial biogenesis. Periodic acceleration administered prior to an athletic event protects against exercise induced asthma. Since many athletic venues do not permit effective drugs for the treatment of asthma because of they also improve performance unrelated to alleviation of asthma, pretreatment of competitive athletes can be accomplished with periodic acceleration to prevent exercise induced asthma. Chronic periodic acceleration treatments should minimize damage that might occur with ischemic events such as stroke, coronary thrombosis, pulmonary embolism, etc." '221 patent, Col. 21:1-19.

"In summary, periodic acceleration treatments control weight, ameliorate the metabolic syndrome, improve sports performance, and improve skeletal muscle pathology associated with the cachexia of COPD and cancers." '221 patent, Col. 22:30-34.

While the '221 patent relies on substantial medical data to reach its conclusions, namely that whole body periodic acceleration increases the production of nitric oxide within the body, the device itself consists of a large, heavy structure that could only be used in a home or laboratory setting. The methods disclosed for using the device of the '221 patent involve administering whole body periodic acceleration to an individual involve the individual lying in a prone position. The individual's feet are attached to a platform, which is itself connected to a motor. The periodic acceleration is induced by movement of the platform through the mechanical capabilities of the motor.

The '221 patent describes numerous medical benefits gained by treatments using its whole body periodic acceleration device. Specifically, the inventor of the '221 Patent documented medical benefits for the following ailments: (A) treat and/or prevent cancer, as well as provide relieve to the unwanted side effects of cancer treatment; (B) serve as a means of preconditioning or conditioning; (C) manage obesity and weight control generally; (D) promote ventricular remodeling; (E) treat and/or prevent atrial fibrillation; (F) managing complications of coronary artery bypass surgery; (G) treat and/or prevent cognitive and learning deficits, behavioral abnormalities, and/or diseases which affect the cognitive function; (H) treat and/or prevent atherosclerosis; (I) promote angiogenesis in ischemic tissues; (J) treat and/or prevent talangiectasia; (K) treat and/or prevent migraines; (L) treat and/or prevent prion diseases; (M) manage the aging process; (N) manage Sjogren's Syndrome; (O) manage Lyme Disease; (P) manage Gulf War Syndrome; (Q) manage miscellaneous pulmonary effects; (R) treat corticosteroid resistance; (S) treat chronic otitis media; (T) promote nail growth and strength; (U) manage the side effects of cell free hemoglobin transfusions; (V) treat radiation injuries; (W) coronary artery disease; (X) diabetes mellitus; (Y)

chronic heart failure; (Z) systemic hypertension; (AA) cerebrovascular accidents; (BB) pulmonary hypertension; (CC) pulmonary embolism; (DD) portal hypertension; (EE) renal failure; (FF) venous stasis; (GG) deep venous thrombosis; (HH) Peripheral Arterial Occlusive Disease; (II) dysmenorrhea; (JJ) pregnancy; (KK) neurological disease; (LL) psychiatric disease; (MM) pain management; (NN) sleep; (OO) glaucoma and other eye diseases; (PP) ear diseases; (QQ) lymphedema; (RR) adult respiratory distress syndrome; (SS) meconium aspiration syndrome; (TT) bone, joint and muscle disease; (UU) wound healing; (VV) HIV infection; (WW) erectile dysfunction; (XX) microgravity; inflammatory disease; (YY) oxidative stress; (ZZ) fibromyalgia; (AAA) chronic fatigue syndrome; (BBB) shock; and (CCC) Raynaud's phenomenon. '221 patent, see also U.S. Pat. Nos. 7,090,648 and 7,111,346 both to Sackner and Inman, and "Acceleration Therapeutics' AT-101 Provides Symptomatic Relief in Fibromyalgia Fibromyalgia & Chronic Fatigue Syndromes," Business Wire, Jun. 23, 2004, http://www.businesswire.com/news/home/20040623005569/en/Acceleration-Therapeutics-AT-101-Symptomatic-Relief-Fibromyalgia-Chronic#.VeuLDbT5MUU, the contents of which are fully incorporated herein by reference.

In addition, nitric oxide release can also aid in the treatment of psychiatric disorders such as schizophrenia, bipolar disorder, and major depressive disorder. Clinical research shows that these disorders can be effectively treated with nitric oxide releasing drugs, such as nitroprusside. See generally https://en.wikipedia.org/wiki/Sodium_nitroprusside, the contents of which are hereby incorporated by reference.

Given the enormous range of health maladies under which people suffer, there is a need to make the benefits of whole body periodic acceleration available to individuals on a smaller scale, for example, with a portable, compact device.

Of course, the idea that a smaller, more portable device could be used to increase blood flow from the lower extremities to the trunk, and heart specifically, has been discussed in the prior art. For example, U.S. Pat. No. 6,569,213 to Busch, entitled "Orthopedic Pedal," ("'213 patent"), the entire contents of which are hereby incorporated by reference is also know. The '213 patent discloses a device to assist a person making voluntary movements of foot, ankle and lower leg muscles, which normally results in a "calf pump" function.

While the '213 discloses a device that is portable, it's benefits are circumscribed to individuals sitting in the same place for extended periods of time. Indeed, the '213 patent was designed for individuals who were traveling in an airplane and who may want to use a foot pedal to improve circulation by taking advantage of the effects of the Calf Pump. The '213 patent could not support the weight of an individual standing on it, for example at a standing desk. Its fulcrum is mid-foot, and therefore, it lacks the stability to support the beneficial continuous fluid motion, such as that described by Sackner in the '221 patent. Furthermore, the '213 patent is designed for a single foot, not to support both feet of an individual while he or she is standing. Moreover, the exerciser disclosed in the '213 patent does not allow for involuntary autonomic nervous system control of movements.

One of the shortcomings of most of these prior art devices is the user's attention must be invested in perpetuating balancing movements of the body's center of mass. Devices are needed that expand autonomic control of postural balance function to be the means of regulating body periodic acceleration. In these prior art devices, autonomic control of balance plays only a minor role in eliciting movement. By way of a non-limiting example, when walking on a treadmill, a user must engage his autonomic control of balance while simultaneously lifting his feet in time with the moving platform underfoot. This is challenging for many people when it is the only task they are doing. But when coupled with a standing desk, the task of walking and working becomes all the more difficult.

There is therefore a need for a portable device that could: (1) take advantage of the physical benefits realized by whole body periodic acceleration; (2) be used with comfort and ease over extended periods of time when an individual is working at his or her desk, watching television, ironing, knitting, eating, reading the newspaper, talking on the telephone, doing laundry, reading, attending a lecture, watching a movie, attending class, working at a tool bench, or otherwise engaged in an activity that heretofore would be undertaken from a sitting position; and (3) elicit the user's autonomous control of postural balance to serve as a means of perpetuating and of reinforcing movements of center of mass associated with whole body physical acceleration.

SUMMARY OF THE INVENTION

The invention disclosed herein overcomes some of the shortcomings of the prior art by facilitating the delivery of pulsatile shear stress to the body's fluid-filled channels containing blood, lymph, or cerebrospinal fluids using a portable apparatus, easily transportable between locations in a home, an office or another workplace, a classroom, or outdoors. The embodiments disclosed herein enable humans to cause reciprocating upward and downward movement of their body's center of mass (CoM) with a minimum of effort expended by the person. Because effort is decreased, users of the present method and apparatus embodiments are able to conserve and focus mental attention on other tasks while simultaneously gaining the medical benefits associated with movement.

The apparatus embodiments of the present invention provide a stable, nonmoving and comfortable standing plate, which supports a user's feet before, during and after the methods of movement disclosed herein. Specifically, these methods provide a restorative assist to a user who shifts his or her center of mass in a downward vertical position with respect to its location in an upright standing position. This type of downward vertical shift in center of mass is typically accomplished when the person standing on the standing step trainer initiates plantar flexion. The body's natural response begins after voluntary plantar flexion causes the standing plate to rotate downward as the forefeet press against the standing plate. After the initial plantar flexion, the natural response of dorsiflexion follows, which is accompanied by bending of the knees. As the knees bend, the center of mass shifts forward and causes further standing plate rotation and continued lowering of center of mass. At this point, the springs decelerate center of mass and postural balance control is again elicited to restore postural stability by plantar flexion to move the center of mass upward and backward again. It is noteworthy that postural balance control in upright standing is maintained by plantar flexion, except in the rare circumstance when the floor is dropping out from underneath one's feet. Thus upon deceleration of the upward movement of the center of mass, continuing plantar flexion causes the forefeet to again press down and reinitiate the process of rotating the standing plate downward. In this way, whole body physical acceleration is perpetuated by autonomic plantar flexion followed by dorsiflexion, then plantar flexion followed by dorsiflexion, and so on.

Dorsiflexion is a postural autonomic response to the standing plate 'tilting' downward, which was caused by plantar flexion. When human begin to feel a vertical change in the ground upon which they are standing, their brains compensate and seek balance by initiating dorsiflexion and knee bending. Knee bending results in a forward movement of the individual's center of mass. The individual's forward center of mass movement has a corresponding spring displacement associated therewith. Plantar flexion leads to dorsiflexion, which in turns leads and greater knee flexion to balance. In addition, a spring force also oppose the downward center of mass. When the user initiates a downward movement of his center of mass by initiating plantar flexion, the energy of the downward movement of his center of mass results in spring compression. After this occurs, the ankles swing back via plantar flexion and knee extension, assisted by the springs in the standing step trainer to return the individual's center of mass to his/her initial position.

In embodiments disclosed herein, deceleration of the downward movement of a user's center of mass can be accomplished while the person's forefeet are pressed against a comfortable rigid platform, also referred to herein as a standing plate, covering one or more elastic bodies, located below the individual's forefeet.

In disclosed methods, users are provided with an assistive force that allows them to return to a typical standing position while simultaneously decreasing the amount of effort required to return to a standing position once a user has lowered his or her center of mass by engaging in knee flexion. These methods are helpful for individuals who desire greater overall fitness and health as well as for individuals who may be recovering from an injury or who may not otherwise have sufficient physical strength to return to a standing position. The standing step trainer could likewise be used by overweight individuals whose body mass is an impediment to sustained exertion. Each of these groups of people would benefit by the assistance provided for user's in the upward vertical direction after they have lowered their center of mass by engaging in ankle flexion or knee flexion.

In some embodiments, the standing step trainer could include a bar, arms, or similar stabilizing feature that would provide support to individuals for whom standing upright and engaging in knee flexion could be difficult.

Embodiments disclosed herein employ the restorative force of one or more elastic bodies located under an individual's forefeet to assist the subject in raising his or her body's center of mass by knee extension to straighten their legs. Exemplary embodiments could employ springs wherein the springs could be chosen so as to minimize energy losses due to spring dampening. In these embodiments, the springs or other elastic bodies could accomplish a restoring force of nearly equal magnitude to forces applied to the platform under the user's forefeet, minus a small loss due to dampening.

By way of example, and without limitation, these springs or elastic bodies could undergo a displacement of somewhere between approximately 1 mm to 10 mm. The spring displacement is naturally proportionally to the restoring force as well as being a function of the weight of the user.

In one embodiment there is disclosed a standing step trainer comprising a planar base suitable for supporting a body weight of a user, wherein the base further comprises a flange member integrally attached to the base, wherein the flange member is designed to secure a planar standing plate so that the connection between the standing plate and the base forms a fulcrum; a first spring secured to the base, the first spring being positioned along a forefoot axis and located a distance y away from the flange member; and the first spring providing a spring rate sufficient to assist a return of a user's ankle or knee to a more vertical position after the user's center of mass has shifted as a result of plantar flexion or dorsiflexion.

In an alternate embodiment, the standing step trainer further comprising a second spring wherein the second spring is secured to the base and is positioned along the forefoot axis; and the second spring providing a spring rate sufficient to assist a return of the user's ankle or knee to a more vertical position after the user's center of mass has shifted as a result of plantar flexion or dorsiflexion.

In an alternate embodiment the distance y is adjustable.

In an alternative embodiment, the distance y is about a length of a distance from a user's heel to a beginning of the user's forefoot.

In yet another embodiment, a length of the distance y from the flange member is between 8 cm and 30 cm.

In yet an alternate embodiment, a separation between springs located along the forefoot axis is between the range of 8 cm to 50 cm.

In an additional embodiment, the spring rate is between the range of 20 lbs./in and 110 lbs./in.

In an alternative embodiment, an angle formed between the base and the standing plate is about 25 degrees.

In an additional embodiment, the standing step trainer further comprising a riser that elevates the vertical flange member, thereby making the standing plate more parallel to a surface upon which the standing step trainer is placed.

In an alternative embodiment, the standing plate is further comprised of a cushioned surface.

Alternative embodiments include a method for increasing the flow of nitric oxide within a human body as compared with a resting state comprising the following steps: (a) standing on a planar base suitable for supporting a body weight of a user, wherein: (i) the base further comprises a flange member integrally attached to the base, wherein the flange member is designed to secure a planar standing plate so that the connection between the standing plate and the base forms a fulcrum; (ii) a first spring secured to the base, the first spring being positioned along a forefoot axis and located a distance y away from the flange member; and (iii) the first spring providing a spring rate sufficient to assist a return of a user's ankle or knee to a more vertical position after the user's center of mass has shifted as a result of plantar flexion or dorsiflexion; and (b) placing a heel on the standing plate; and (c) initiating plantar flexion.

An alternate method embodiment further comprising a second spring wherein the second spring is secured to the base and is positioned along the forefoot axis; and the second spring providing a spring rate sufficient to assist a return of the user's ankle or knee to a more vertical position after the user's center of mass has shifted as a result of plantar flexion or dorsiflexion.

In an additional method embodiment, a length of the distance y is adjustable.

In an alternate method embodiment, the distance y is about a length of a user's heel to the beginning of the user's forefoot.

In yet an alternate method embodiment, a length of the distance y is between 8 cm and 30 cm.

In an additional method embodiment, a separation between springs located along the forefoot axis is between 8 cm and 50 cm.

In an alternative method embodiment, the spring rate is between the range of 20 lbs./in and 110 lbs./in.

In an alternate method embodiment, an angle formed between the base and the standing plate is about 25 degrees.

In an alternative method embodiment, there can be a riser that elevates the vertical flange member, thereby making the standing plate more parallel to a surface upon which the standing step trainer is placed.

In an alternate embodiment, the standing plate is further comprised of a cushioned surface.

DETAILED DESCRIPTION

Figure 1:
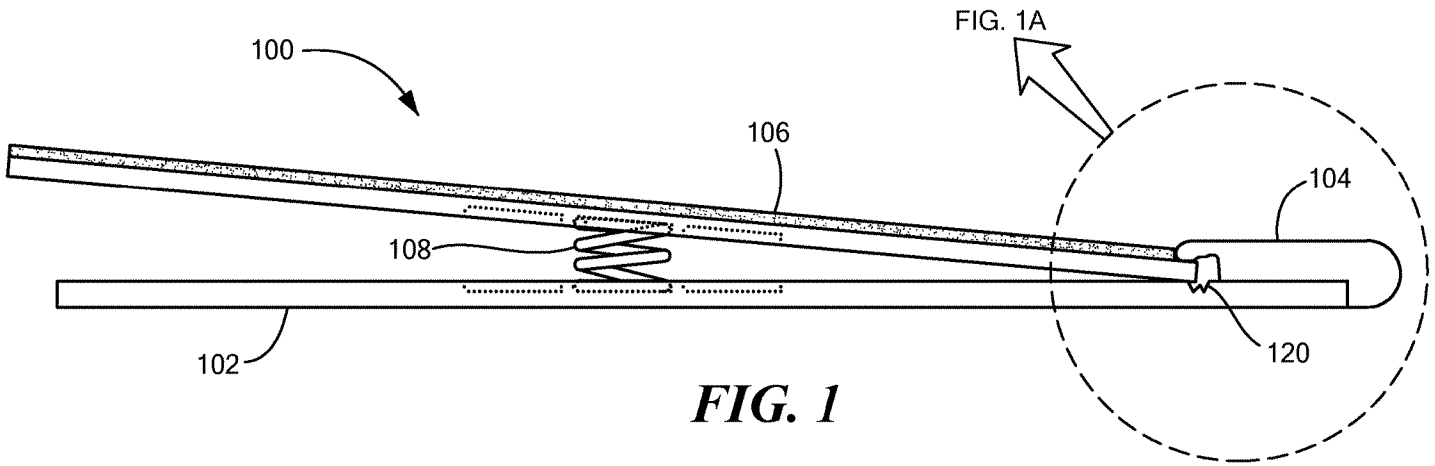
FIG. 1 is a left side elevation view, the right side elevation view being the mirror image thereof, of a standing step trainer of the present invention.

Those of skill in the art will recognize throughout this specification that when like terms are used to describe features and functionalities of various portions of a particular embodiment, those same features and functionalities could be present in additional embodiments having aspects with like terms.

It is well known in society generally that exercise is beneficial to overall health. Among such benefits are the improvements in circulatory system functioning attributed to rhythmic muscle compression on circulatory system vessels, to shear forces acting within blood and lymph filled vessels due to muscle movements and to gravitational forces exerted on the body while exercising.

Adequate daily physical activity benefits individuals in part by contributing to forces acting on their body's volumes of circulating blood, lymph, and cerebrospinal fluid. Such forces include those exerted by working muscles on the circulatory vessel walls due to their placement among and between muscles, as for example in the leg calf muscles which cause increased movement of blood and lymph, and thereby facilitate the return of venous blood and lymph fluid from the lower legs into systemic circulation.

The movement of fluids within the body's circulatory systems produces shear forces at the lumen walls within circulatory channels. Pulsatile application of these shear forces through repetitive body motion leads to increased production of the circulatory mediator nitric oxide (NO) and to higher expression of nitric oxide synthase (NOS) isoforms responsible for NO production.

One example of a medical publication correlating enhanced vascular function and structure with exercise-induced increases in blood flow and shear stress can be found in a study in the Journal of the American College of Cardiology entitled "Cardiovascular Effects of Exercise: Role of Endothelial Shear Stress," the entire contents of which are hereby incorporated by reference. Niebaur, Josef, MD and Cooke, John P. MD., "Cardiovascular Effects of Exercise: Role of Endothelial Shear Stress" JACC Vol. 28, No. 7, 1652-1660, December 1996. In this study, Doctors Niebaur and Cooke observed that "regular aerobic exercise reduces cardiovascular morbidity and mortality in the general population as well as in patients with coronary artery disease is strongly supported by evidence derived from epidemiologic studies. Physically active people also experience fewer clinical manifestations of coronary artery disease than do less active men and women. By contrast, sedentary life-style has been identified as a risk factor for development of coronary artery disease, and there is a strong correlation between physical inactivity and cardiovascular mortality." Id. at 1652.

"Experimental studies and clinical observations indicate that there is a significant correlation between regular physical exercise and an increase in the lumen diameter of coronary arteries . . . . In addition to changes in vascular structure, changes in vascular tone may be induced by long-term regular exercise." Id. at 1652-53.

"The two principal forces acting on the blood vessel are pulsatile stretch and shear stress. Pulsatile stretch is determined by fluctuation in arterial pressure and is a force exerted at a vector that is perpendicular to the longitudinal axis of the vessel. Shear stress is determined by blood flow and is a tractive force exerted at a vector that is parallel to the long axis of the vessel. The preponderance of scientific data suggests that exercise-induced increases in endothelial shear stress has beneficial effects on vascular structure and reactivity." Id. at 1653.

To clarify, it is not necessarily fluid movement that periodic acceleration induces directly. The fluids generally are already in motion while periodic acceleration induces additional forces acting on fluids and also acting on cells and other particles borne within fluids carried by vessels. These fluids and particles exposed to gravitational acceleration exert increased shear strain (drag) at vessel walls and thereby cause increasing enzymatic production of nitric oxide. The nitric oxide produced therefrom influences many outcomes in muscle tissues, especially as a result of subsequent increases in fluid volumes moving through vessels as a consequence of nitric oxide-mediated dilatation of vessels.

"Evidence is accumulating that regular exercise can exert beneficial effects on vascular reactivity, and that these salutary changes are due to exercise-induced increases in blood flow. Long-term changes in flow exert their effects on endothelium-dependent vasodilation by modulating the expression of NO synthase." Id. at 1655. "There is now abundant epidemiologic and experimental evidence indicating that physical exercise slows the progression of vascular disease and reduces cardiovascular morbidity and mortality. The mechanisms of this effect include beneficial changes in lipoprotein profile, rest blood pressure and heart rate, carbohydrate tolerance, neurohormonal activity and exercise-induced increases in blood flow. Exercise-induced increases in blood flow appear to have direct effects on vascular function and structure. Flow enhances endothelium dependent vasodilation by increasing the vascular expression of NO synthase and by enhancing the release of NO and prostacyclin." Id. at 1657.

The Role of Endothelial Shear Stress in Overall Health

According to a published study performed by Saurabh S. Thosar et al., entitled "Sitting and endothelial dysfunction: The role of shear stress," the entire contents of which are hereby incorporated by reference, "Sedentary activity is a modifiable life-style behavior and a key component in the etiology of athrerosclerotic cardiovascular disease (ACVD). US adults and children spend more than half their waking time in sedentary pursuits. Sedentary activity has been shown to result in impaired insulin sensitivity, impaired metabolic function and attenuated endothelial function, which are classic markers of ACVD. Sedentary activity is defined as 'sitting without otherwise being active.' This behavior promotes reduced muscular activity of the lower extremities which decreases leg blood flow, increases blood pooling in the calf, augments mean arterial pressure, and deforms arterial segments resulting in low mean shear stress (SS). SS activates distinct physiological mechanisms which have been proposed to be protective against ACVD; specifically, through a SS-induced endothelium-derived nitric oxide mechanism." Thosar, Saurabh S., et al., "Sitting and endothelial dysfunction: The role of shear stress," Med. Sci Monit, 2012; 18 at RA173.

This same group stated: "Life-style factors are significant components in the etiology of atherosclerotic cardiovascular disease (ACVD), malignant neoplasms, and cerebrovascular disease which are the leading causes of death in this country . . . . Diet and physical inactivity are only second to tobacco in life-style contributors for all-cause mortality. Along these lines, physical activity is used as a primary intervention to help prevent and treat these diseases." Id. At RA174.

On the physical effects of sitting, the Thosar team stated: "Sitting as a model introduces distinctly different physiological mechanisms (e.g. low shear stress, bent artery system, hydrostatic load, pooling of blood) when compared to traditional physical inactivity models." Id.

With respect to endothelial dysfunction in ACVD and the role of nitric oxide in proper endothelial function, the Thosar team opined "The endothelium is a single layer of cells lining nearly all of the vascular system and it performs anti-atherogenic functions; such as anti-coagulation, fibrinolysis, anti-inflammation, anti-adhesion, and regulates permeability as well as vasomotor control." Id. "Nitric oxide is the key to endothelial function, involved with all the anti-atherogenic properties of the endothelium." Id.

Discussing physical activity (PA) and its role in overall blood flow, the Thosar team noted: "In the intact organism, PA increases blood flow to various tissues in the body. Shear stress is the resulting tangential force due to blood flow across the endothelium and is essential for the release of vasoactive substances (i.e. nitric oxide), gene expression, cell morphology, and cell metabolism. Shear stress also preserves endothelial cell stability and prevents apoptosis, maintains endothelial integrity, and prevents cell proliferation. Correspondingly, a reduction in blood flow or insulin sensitivity reduces nitric oxide bioavailability and attenuates endothelial function, thus creating a pro-atherogenic environment." Id. at RA 175.

The Thosar team concluded that: "The nature and magnitude of shear stress influences the structure of the vessel and function of the endothelial cells. Areas of high shear stress (>15 dynes/cm3) have preserved endothelial function and are relatively protected from atherosclerosis; whereas arterial segments with low shear stress (<4 dynes/cm3) are exposed to the pathology of the disease. There is also a strong correlation between areas of low shear stress (i.e. arterial branch points) and endothelial dysfunction. Thus, low mean shear stress has been identified as one of the etiologies of atherosclerosis and cardiovascular disease. Shear stress associated with exercise appears to augment the bioavailability of nitric oxide, which is important for the prevention of atherosclerosis. Exercise episodically increases shear stress and subsequently improves endothelial function. However, the increase in shear stress appears to be ephemeral and it seems logical that long bouts of sedentary activity maintain a state of low shear stress which prohibits an increase in endothelial function. Indeed, after only 30 minutes of sitting, antegrade shear is reduced and following only one hour of sitting, blood pools in the leg, thigh blood flow decreases, and blood viscosity increases. In this context, repeated sedentary activity appears to expose to the endothelium to a pro-atherogenic milieu, whereas repeated bouts of activity interrupt the harmful hemodynamic environment associated with sedentary activity. Today, most jobs and leisure time activities involve hours of continuous sitting. The underlying nature of sitting does not promote muscular contractions, augmented energy expenditure, or increased blood flow. Sitting also changes the angle at which major arteries (femoral and popliteal) run; as compared to a standing or supine posture. Bends within the arterial tree alter flow patterns which have been shown to affect the atherosclerotic process. Due to the predominantly seated posture during sedentary activity, turbulent blood flow might be augmented in deformed arterial segments of the lower extremities. The turbulent flow may also be an underlying mechanism for the prevalence of atherosclerosis in the femoro-popliteal arterial segment. Additionally, shear rate (estimate of shear stress without accounting for blood viscosity) is lower in the femoral artery versus the brachial artery in the supine, standing, and seated positions." Id. at RA178.

Periodic Acceleration Improves Vascular Endothelial Function

In a companion study, Arkady Uryash et al. study, published under the title "Low-amplitude pulses to the circulation through periodic acceleration induces endothelial-dependent vasodilation," the entire contents of which are hereby incorporated by reference, the authors concluded that "Low-amplitude pulses to the vasculature increase pulsatile shear stress to the endothelium, [which] activates endothelial nitric oxide (NO) release and endothelial nitric oxide (NO) synthase (eNOS) to promote NO release and endothelial-dependent vasodilatation." Arkady Uryash, et al., "Low-amplitude pulses to the circulation through periodic acceleration induces endothelial-dependent vasodilation," J. AP. Physics, 1840-47 (2009). This team concluded that the "addition of low-amplitude pulses to circulation through pGz produces endothelial-dependent vasodilatation due to increased NO in rats, which is mediated via activation of eNOS, in part, by the Akt/PI3K pathway." Id. at 1840.

The Uryash team observed that, in the context of supine individuals, "Periodic acceleration (pGz) (motion of the supine body head to foot on a platform) provides systemic additional pulsatile shear stress. The purpose of this study was to determine whether or not pGz applied to rats produced endothelial-dependent vasodilatation and increased NO production, and whether the latter was regulated by the Akt/phosphatidylinositol 3-kinase (PI3K) pathway." Id. at 1840.

Uryash et al. further document that "Added low-amplitude pulses to the vasculature were generated with periodic acceleration (pGz). pGz is produced by a motorized platform that repetitively moves the horizontally oriented body sinusoidally in a head to foot direction. Inertia of fluid as the body accelerates and decelerates adds a small-amplitude pulse to the circulation that is superimposed on the natural pulse, increasing pulsatile shear stress to the endothelium. In large-animal models, increased pulsatile shear stress activates endothelial nitric oxide (NO) synthase (eNOS) to release NO into the circulation, which, in turn, induces endothelial-dependent pulmonary and systemic vasodilatation, as well as increasing organ blood flows. pGz applied to anesthetized swine increases serum nitrite, which is a qualitative marker for the release of NO. pGz leads to a phosphorylation of eNOS that is correlated with a phosphorylation of Akt in endothelial cells (48). The release of NO into the circulation with pGz has been shown to be physiologically meaningful and long lasting in a sheep model of asthma. Additionally, pGz applied to human subjects increases brachial flow-mediated vasodilation and induces release of NO, which is comparable to light to moderate exercise." Id. at 1840.

In their study, the Uryash team concluded that periodic acceleration produced increase NO into the circulation. Id. at 1845. Moreover, periodic acceleration applied to sedentary adults improved their vascular endothelial function. Id. The authors further observed that eNOS protein expression is increased after one hour of periodic acceleration, thereby leading them to surmise that periodic acceleration upregulates eNOS, which, via NO production, can explain the observed improvement in endothelial function. Id.

Motion of the human body's center of mass can lead to gravitational forces that in an erect body posture may be applied along circulatory channels with a head to toe orientation. Applied in this way, shear forces can be exerted on the circulatory vessel walls throughout much of the body and thereby produce certain benefits attributed to bodily physical activity. Some examples of such center of mass motion that many people will be familiar with are exercise maneuvers such as jumping jacks, jumping rope, or riding a pogo stick. These illustrative examples involve reciprocating, upward then downward, motion of the body's center of mass that results in pulsatile shear forces on circulatory vessel walls. Considerable mental attention, physical skill, as well as physical stamina are required to perform these maneuvers for any extended period of time.

U.S. Pat. No. 6,155,976 granted to Sackner, et al. ("the '976 patent"), the contents of which are hereby incorporated by reference, describes passive physical activity that enables pulsatile shear forces to be applied in what were termed fluid-filled channels of a human subject's body lying supine on a reciprocating platform assembly that is transported in a back and forth, headward to footward motion. The person undergoing this motion does not have to be conscious nor does he/she have to exert any energy to gain the physical benefits of applying pulsatile shear forces applied to fluid-filled channels within his/her bodies.

The inventive apparatus and methods described herein allow users to take advantage of the results of the medical studies and advancements cited herewithin, as well as those known to skilled practitioners.

Turning first to an apparatus, referred to throughout as a standing step trainer, that can be used to achieve the health benefits noted herein, FIG. 1 depicts an embodiment of a standing step trainer 100. The standing step trainer 100 is comprised of a planar base 102 suitable for supporting the body weight of a user. In terms of users, the standing step trainer 100 is optimally designed for humans, and therefore users can vary in age and size from very small children to adults of all heights and weights. In alternate embodiments, the planar base 102, also called simply a "base" can be made of wood, wood laminate, metal, hard plastic, durable foam, granite, stone, and the like.

The planar base 102 is further comprised of a flange member 104, wherein the flange member 104 can be affixed to the base 102 or it could be an integral part thereof. Either way, the flange member 104 is designed to secure a standing plate 106 along its horizontal axis in such a way so as to create a fulcrum point for the standing plate 106. In this way, the standing plate 106 is able to support the weight of a user and to act as a fulcrum when a user engages in ankle or knee flexion thereby changing his or her center of mass.

The dimensions of the base 102 and the standing plate 106 are approximately equal, when subtracting the length of the flange member 104. Although it will be clear to one of skill in the art that these dimensions could vary without changing the inventive methods and apparatuses disclosed herein, exemplary dimensions are length and width ranging from 15 cm to 100 cm and height ranging from 0.5 cm to 3 cm.

In terms of the means by which the standing plate 106 could be secured so as to create a fulcrum, these of skill in the art will recognize that the securing means could be mechanical, such as hinges, bolts, clamps, screws, pins, and the like, or geometrical, such as by creating a c-shaped carve out within the flange member 104 and a groove 120 along the base 102 into which an end of the standing plate 106 could snuggly fit.

Figure 1A:
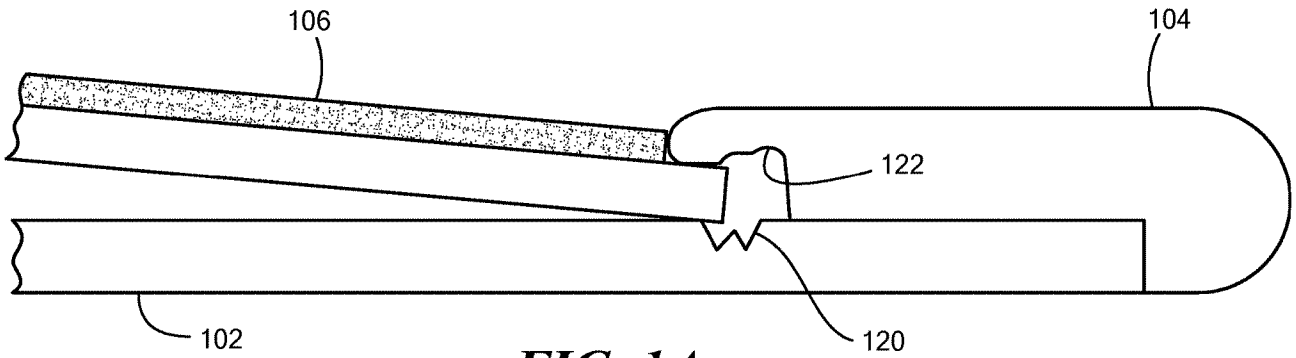
FIG. 1A is a cutout of a left side elevation view, the right side elevation view being the mirror image thereof, of a standing step trainer of the present invention.

In this configuration, shown in FIG. 1A, the groove 120 provides a point of friction for the edge of the standing plate 106, which in turn creates a fulcrum between the standing plate 106 and the base 102. This fulcrum allows the transfer of forces when a user is moving across the surface of the standing plate 106 resulting in a smooth flow of upward and downward assisted movement. In this embodiment, the standing plate 106 can be held securely in place along its top surface by virtue of a c-shaped cutout 122 along an edge of the flange member 104. In this embodiment, the standing plate could be tapered at the point of connection with the c-shaped cutout 122 in order to provide a stable means of connection between the standing plate 106 and the base 102. In some embodiments, the angle between the base 102 and the standing plate 106 could be approximately 25 degrees.

Referring again to FIG. 1, there is shown a coil spring 108 having a tensile force sufficient to assist a return of a user's ankle or knee to a more vertical position after the user's center of mass has shifted as a result of ankle flexion or knee flexion. The coil spring 108 in some embodiments is made of metal, fiber-reinforced plastics maybe a suitable material in another embodiment. In alternate embodiments, the spring 108 could be a plate that flexes under load and similar mechanical structures known to those of skill in the art. In preferred embodiments, the coil spring 108 tensile strengths at ambient temperature vary with wire diameter from 240,000 to 340,000 pounds per square inch; the height of the spring 108 in an at-rest position (spring free length) can range from 1 cm to 10 cm, while the coil diameter can range from 1 cm to 16 cm. Those of skill in the art will recognize that these dimensions can vary depending on tensile strength of the spring 108 without changing the underlying inventive concepts disclosed herein.

Figure 2:
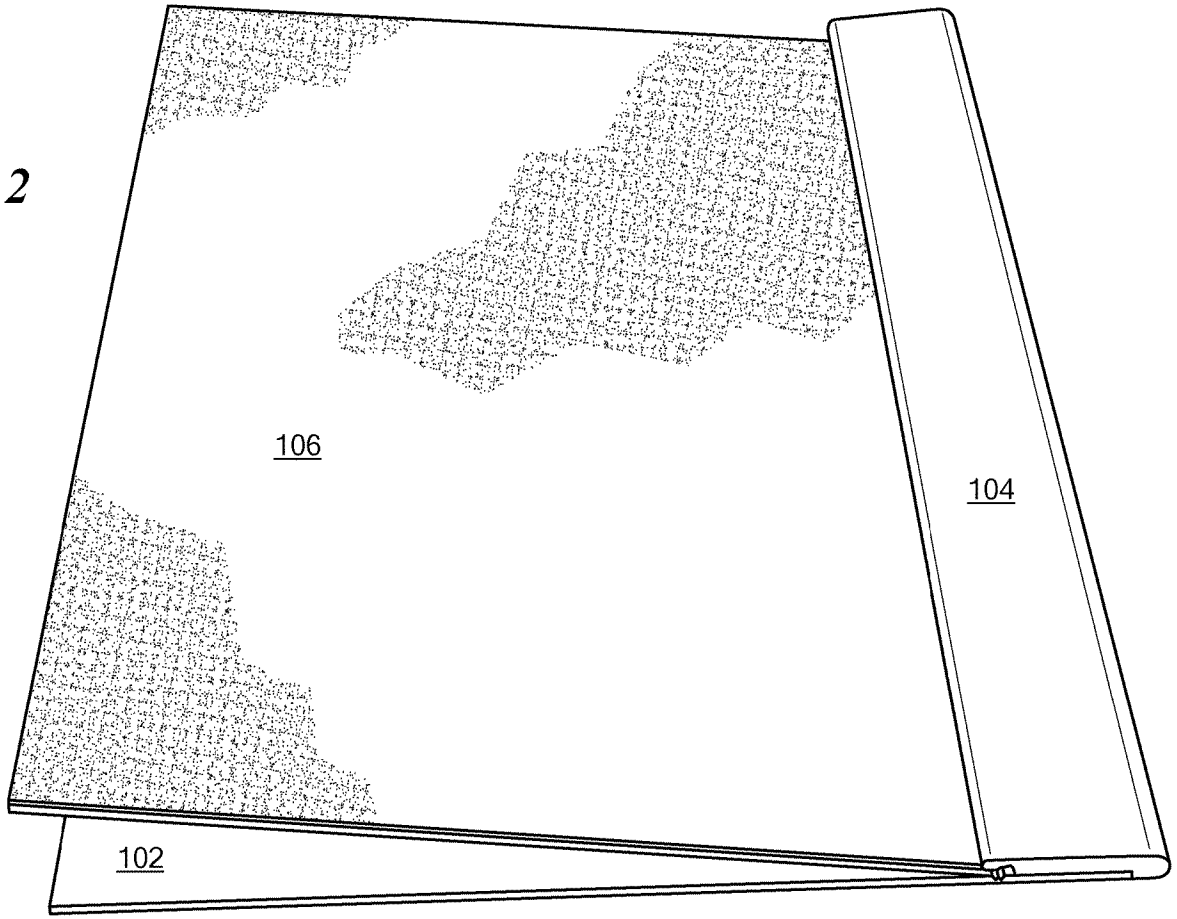
FIG. 2 is a top plan view, the bottom plan view being a mirror image thereof, of an embodiment of the standing step trainer of the present invention.
Figure 2A:
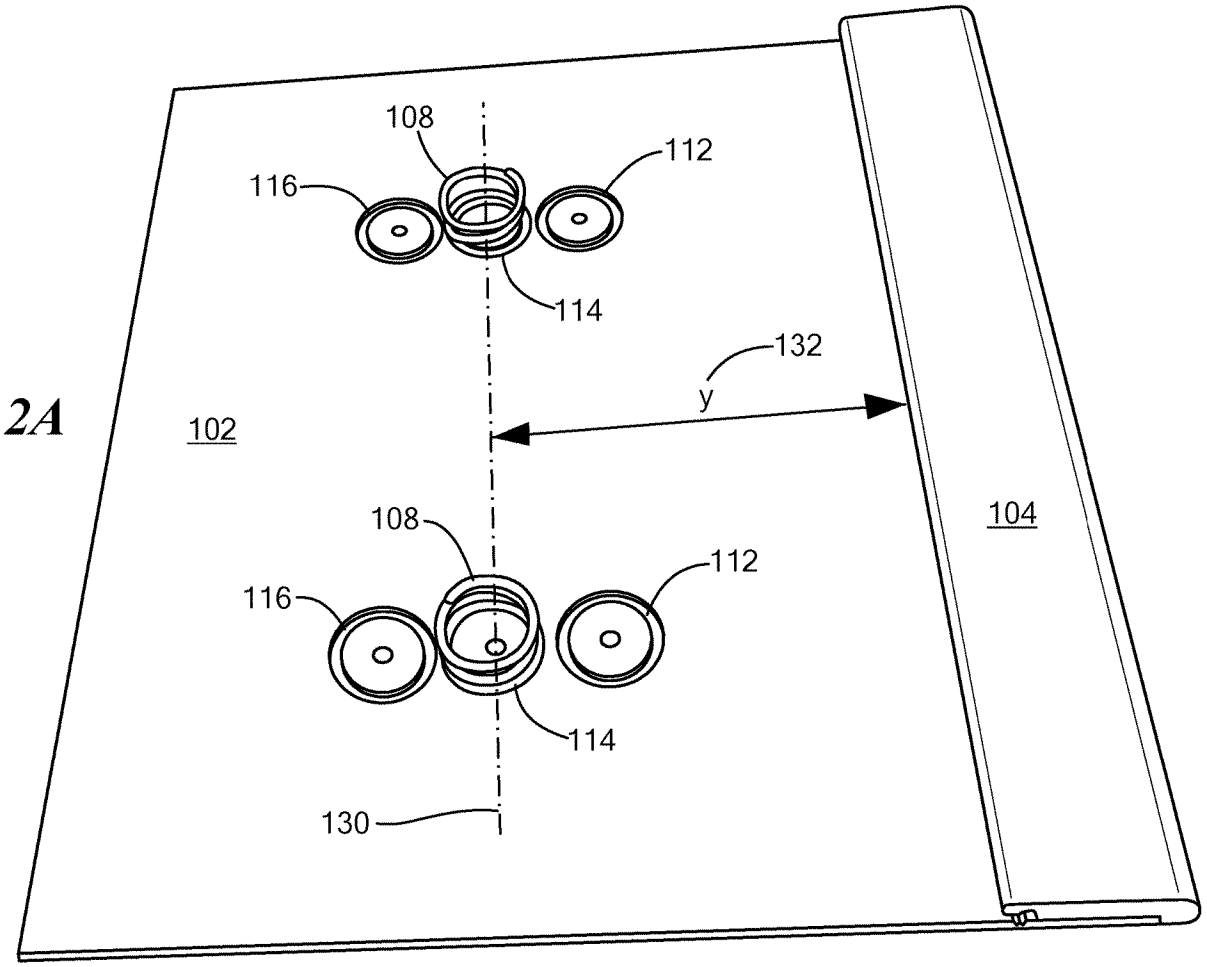
FIG. 2A is a cutout of a top plan view, the bottom plan view being a mirror image thereof, of an embodiment of the standing step trainer of the present invention.

FIG. 2 is a top plan view of an embodiment of the standing step trainer 100 having two springs 108. FIG. 2A is a cutout of the top plan view of FIG. 2. With reference to FIG. 2A, there is shown the base 102 having six spring recesses 112, 114, and 116 for securing the spring 108 to the base 102. The dimensions of the spring recesses 112, 114, and 116 are chosen to create a housing for the spring 108 that is deep enough to hold the spring in place when a user is standing on the standing plate 106 or otherwise using the standing step trainer 100. Similarly, the diameter of the inner and outer circles of spring recesses 112, 114, and 116 should coincide with the diameter of the inner and outer portions of the spring 108. In this way, spring recesses 112, 114, and 116 provide a secure receptacle into which the spring 108 fits.

Figure 2B:
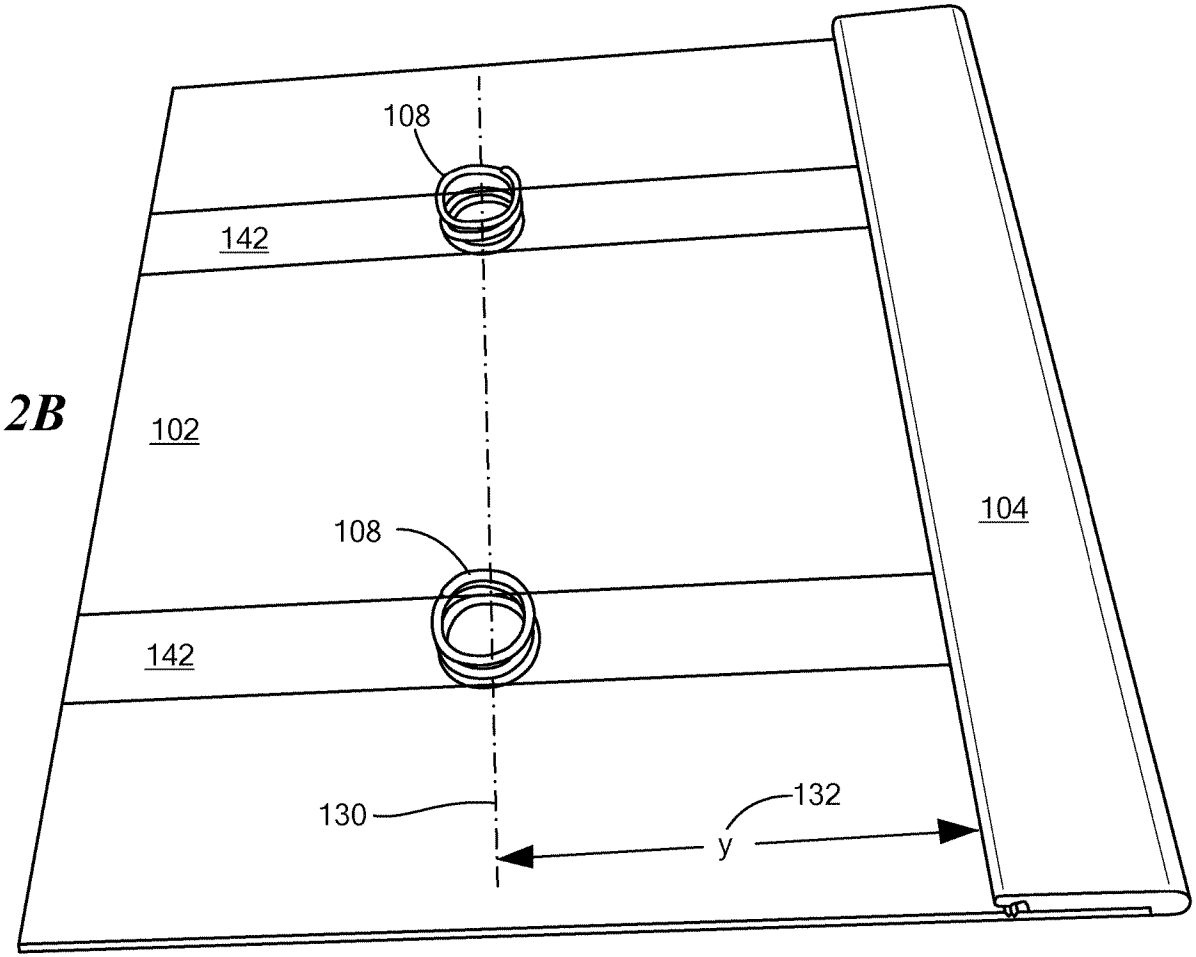
FIG. 2B is a cutout of a top plan view, the bottom view being a mirror image thereof, of an embodiment of the standing step trainer of the present invention.

FIG. 2B depicts an alternate embodiment wherein the spring recesses 112, 114 and 116 have been replaced by a magnetic strip 142. In this embodiment, base 102 has two magnetic strips 142. In alternate embodiments, there could be a single magnetic strip 142 or a plurality of magnetic strips 142, i.e., two or more. Irrespective of the number, the magnetic strips 142 can be used to position spring 108 anywhere therealong so as to allow the user to choose the distance of the spring 108 from the fulcrum.

In preferred embodiments, the user would position the springs 108 so that they were under the beginning of his forefoot. Obviously, depending on the foot size of the user, this distance would vary. By placing the springs 108 under the user's forefoot, the methods and apparatuses disclosed herein capitalize on the body's autonomic response of seeking balance when plantar flexion results in a downward movement of the standing plate 106.

As has been described throughout, once the standing plate 106 begins a downward trajectory, the autonomic response within a user's brain will seek to regain balance underfoot by initiating dorsiflexion and knee bending followed by additional plantar flexion to recover upright posture with knee straightening. When these movements are combined, one after another, and taking into account the automatic assist provided by springs 108, the resulting motion of a downward movement of center of mass 302 followed by an upward movement of center of mass 302 emulates the relaxing back and forth movement of a rocking chair. This movement is at once relaxing and conducive to increasing movement and therefore fitness.

By way of example, and without limitation, in one embodiment, spring 108 could be metal compression spring coils made of durable music wire of 0.14-inch diameter. The wire ends could be ground and squared. The outside diameter of the spring 108, and therefore of the spring recesses 112, 114, and 116 or the width of the magnetic strips 142, could be about 1.456 inches, and the inside diameter could be about 1.268 inches. The spring 108 height, i.e., free length of spring, could be about 0.825 inches. The spring 108 could have three coils and one active coil. The calculated spring rate constant could be about 247.9 lbs./inch. The spring rate could range from 20 lbs./in. to 110 lbs./in in some embodiments. The maximum compression of each coil within the spring 108 could be about 10 mm, the sum of distances between the active coil and inactive coils.

In the embodiment shown in FIG. 2A, the spring 108 is secured to the base 102 by placing the spring 108 within spring recesses 112, 114, and 116, which are essentially drilled cutouts within the base 102. In alternate embodiments, spring 108 could be secured to base 102 via a magnetic strip, as shown in FIG. 2B or via a clamp, bolt, bracket, adhesive, Velcro, pin, or like mechanism known to those skilled in the art. The forefoot axis 130 depicts a horizontal line running through the center of the springs 108. In preferred embodiments having two springs 108, the separation will be approximately hip width of the user. In some embodiments, the separation between the springs 108 located along the forefoot axis 130 will be between 8 cm and 50 cm. Those of skill in the art will recognize that if there were more than two springs 108 in some embodiments, they could be placed within approximately the same range of separation along the forefoot axis 130.

FIGS. 2A and 2B also show a forefoot axis 130 located a distance y 132 from an edge of the flange member 104. In embodiments having two springs 108 the distance between each of the springs along the forefoot axis could range from 8 cm to 50 cm. The distance y 132 depends upon the size of the foot of a user desiring to use the standing step trainer 100. The range of the distance y 132 could be from 8 cm to 30 cm, but will vary depending on foot size of the user. In preferred embodiments of the methods described herein, a user will position his heels fairly close to flange member 104 when he is using the standing step trainer 100. The distance y 132 will depend upon where a user positions his heels because preferred motion is enabled when a user's forefeet are placed on standing plate 106 above the center of springs 108.

Referring to FIG. 2A, there are three spring recesses 112, 114, and 116. Each of these spring recesses 112, 114, and 116 is a different distance y 132 from an edge of the flange member 104. Most users of the standing step trainer 100 will find it most comfortable to place the spring 108 under the base of their forefoot when they are standing astride the standing plate 106. Users with smaller feet will likely choose to place springs 108 in spring recess 112, while those with larger feet may choose spring recess 114 and those with the largest feet may choose spring recess 116. As stated above, alternate embodiments having a magnetic strip for locating spring 108 will provide additional flexibility in terms of accommodating the various foot sizes and proclivities of users with respect to the distances they prefer for locating spring 108 with respect to the fulcrum created by flange member 104, standing plate 106 and base 102. Similarly, in FIG. 2B, users have a wide range of flexibility in terms of choosing the distance y 132 upon which to place springs 108.

In an alternate embodiment, a user could place a riser under the base 102, preferable under flange member 104. This embodiment may be desirable for children who weigh less than adults, for example. By placing a riser under base 102, standing plate 106 becomes more horizontal with respect to the surface upon which standing step trainer 100 is placed. When standing plate 106 is more horizontal, it takes less effort when initiating plantar flexion to have standing plate 106 move downward. This in turn means tat less dorsiflexion is required to gain the benefits of the spring assisted lift of the standing plate 106. For children, the elderly, or individuals having less leg strength than healthy adults, the riser would allow these individuals to enjoy the relaxing health benefits of the standing step trainer 100.

Figure 3:
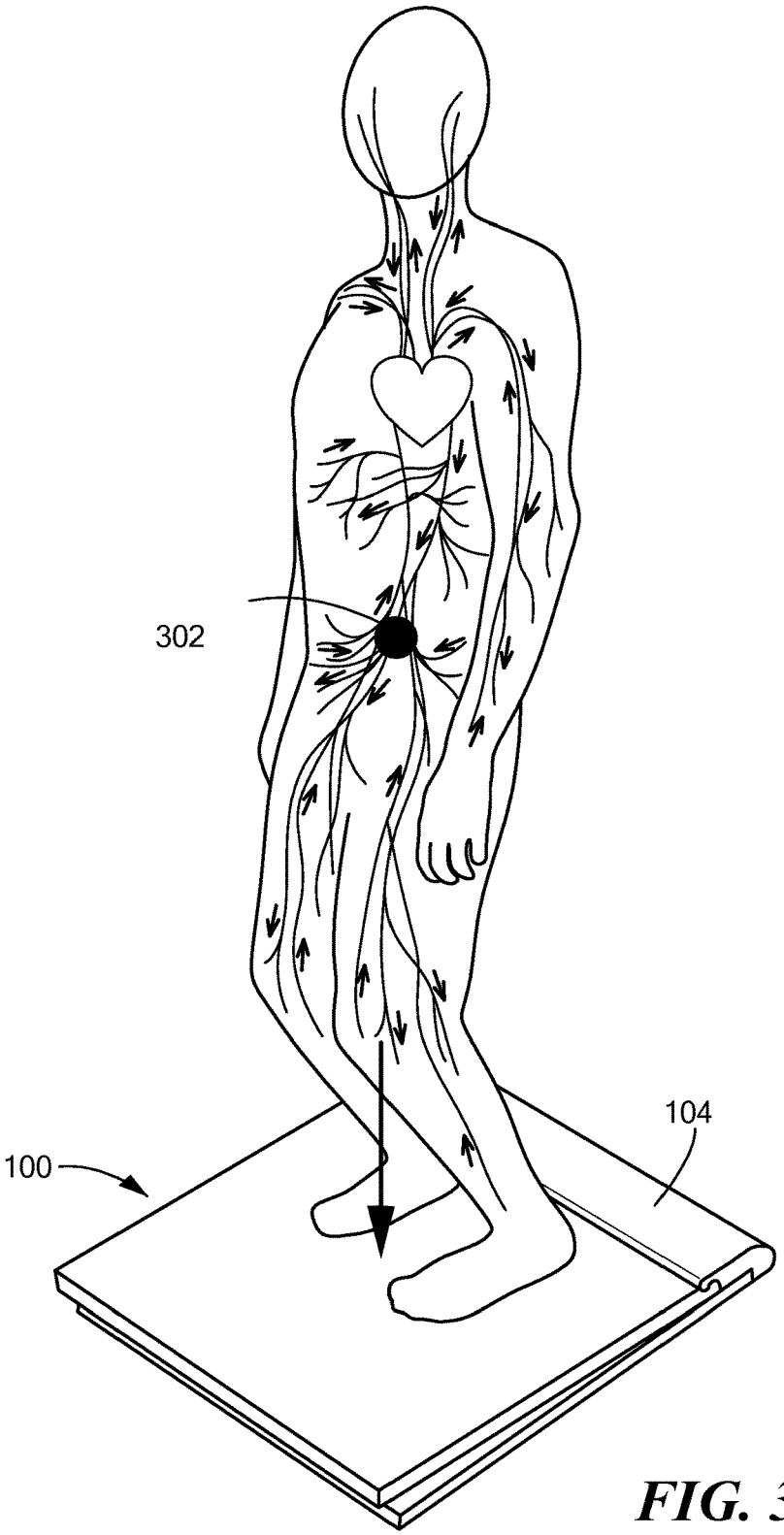
FIG. 3 is a perspective view of a user on the standing step trainer.

In terms of using the standing step trainer 100, FIG. 3 shows a user positioned on the standing step trainer 100. The user's ankles and heels are placed just forward of an edge of the flange member 104. In alternate methods, a user may place his feet on flange member 104 if so desired without affecting the benefits described herein. Although the standing plate 106 is tilted slightly upward, the user's weight is distributed between the edge of the flange member 104, which is the point at which a fulcrum is created, and the springs 108 before knee flexion. In an upright standing position, nearly all of the user's weight can be applied to fulcrum position located at an edge of the flange member 104.

An individual uses the standing step trainer 100 by engaging in ankle plantar flexion, which moves the user's center of mass 302 forward. As a result, the standing plate 106 tilts downward, which engages a postural balance response in the form of dorsiflexion and knee flexion. The result of the knee flexion is to further lower the individual's center of mass 302. When the user's center of mass 302 drops in the vertical plane, the springs 108 oppose the downward movement, while simultaneously decelerating the user's center of mass 302. Experienced users allow the springs 108 to do the deceleration thereby minimizing tension in the knees.

When the user's center of mass 302 drops, the springs 108 compress until the completion of the deceleration of the user's center of mass 302. The energy stored within the spring 108 is equal to the product of spring constant and squared distance over which springs 108 were compressed. In a preferred embodiment having metal coil compression springs, the spring constant (k) is equal to:

$Gd^4/8D^3n$, where: G is shear modulus of steel, which can be approximately 800 kg/mm; d is wire diameter; D is coil diameter; and n is number of turns in coil.

After deceleration halts downward movement, gravitational force on the user's center of mass 302 is offset by forces exerted by the springs 108. The spring restoring force then lifts the front of the standing plate 106. At this point, the user's ankle dorsiflexion and knee flexion convert to plantar flexion and knee extension that facilitates backward movement of the user's ankles After releasing enough energy from the springs 108 to allow gravitational deceleration of the center of mass 302 to begin, ankle extension and knee extension direct the center of mass 302 to a maximum vertical position over backward-extended ankles. The energy stored within springs 108 is released in an upward vertical direction providing an assistive lift to the user's center of mass 302 and commensurate assist in the straightening of the user's knee. The result from a user's perspective is, he or she can bend and straighten his/her knees more easily because knees are not leveraged by gravitational acceleration of center of mass 302 as would be the case if there were no springs 108 involved. The reciprocating forward and backward movement of the center of mass 302 is also assisted by the springs 108, which enable knees to bend and straighten easily.

This action, that is engaging in rhythmic knee flexion, has tremendous health benefits as discussed herein. Principally, repeated knee flexion results in raising and lowering of center of mass 302 or periodic physical acceleration of center of mass 302 that increases the flow of nitric oxide throughout the bloodstream. The medical benefits of increased nitric oxide flow, as well as the calf pump that occurs when one engages in dorsiflexion have been discussed at length in the articles, patents, and publications cited and incorporated by reference herein. When individuals use the standing step trainer 100, the elevated nitric oxide in their blood stream from endothelial cells increases the expression and stability of Sirtuin-1, an enzyme widely distributed throughout all tissues. Sirtuin-1 has been determined to play a central role in cell survival and senescence, metabolism, and longevity. The influence of nitric oxide from endothelial cells on Sirtuin-1 is an emerging consensus view, which highlights the importance of activity level as being a crucial determinant of overall health. See e.g., "NO Targets SIRT1 A Novel Signaling Network in Endothelial Senescence," Potente M., Dimmeler S. Arteriosclerosis, Thrombosis, and Vascular Biology 2008; 28: 1577-1579; see also "Nitric oxide, interorganelle communication, and energy flow: a novel route to slow aging,'" Valerio A., Nisoli E., Front Cell Dev Biol. 2015; 3: 6., the entire contents of which are hereby incorporated in their entirety.

The embodiments of the standing step trainer 100 allow users of all physical abilities and sizes to take advantage of these health benefits. For example, for individuals who have difficulty walking, perhaps due to age, or a physically incapacitating accident, the standing step trainer 100 allows those individuals to benefit from myriad health benefits attendant to the increased nitric oxide flow within their venous systems. The apparatuses and methods disclosed herein promote continuation of shear stress to levels commonly evident in endurance exercise activities known to prevent the decline of nitric oxide bioavailability throughout the aging process. See e.g., "Lifelong physical activity prevents an age-related reduction in arterial and skeletal muscle nitric oxide bioavailability in humans," Nyberg M., Blackwell J. R., Damsgaard R., Jones A. M., Hellsten Y., Mortensen S., J Physiol 2012; 590, 5361-5370, the entire contents of which are hereby incorporated by reference.

On the other end of the fitness spectrum, individuals who desire to work all day at a standing desk and who would like to introduce movement into their work will greatly benefit from the standing step trainer 100 because they will be able to stand for longer periods of time and will be able to move without expending a noticeable amount of mental energy on maintaining balance, movement, and speed. This is so because the movements engaged in on the standing step trainer 100 mimic walking, although they are less physically taxing because the spring 108 provides an assist in the return of a knee to a more upright position. Most people learn to walk when they are very young. As a result, the mechanics of walking are engrained within the motor cortex of the brain.

An additional benefit is much less physical energy and exertion are required than would be the case if one were walking, running or otherwise proceeding with endurance activity. The benefits of using the standing step trainer 100 include an overall reduction in the amount of food one must consume, liquids one must drink, and sleep one must get as compared with working at a standing desk accompanied by a treadmill or other piece of exercise equipment requiring vigorous physical activity.

Indeed, the standing step trainer 100 capitalizes on the inherent need for humans to find balance in maintaining an upright posture. A recent study is illustrative. In the article entitled "Human postural sway results from frequent, ballistic bias impulses by soleus and gastrocnemius," Ian D. Loram et al. noted "[p]reviously, we have used balancing of a real inverted pendulum to make predictions about human standing. Here we test and confirm these predictions on 10 subjects standing quietly. We show that on average the calf muscles are actively adjusted 2.6 times per second and 2.8 times per unidirectional sway of the body's center of mass (CoM). These alternating small (30-300 μm) movements provide impulsive, ballistic regulation of CoM movement. The timing and pattern of these adjustments are consistent with multisensory integration of all information regarding motion of the CoM, pattern recognition, prediction and planning using internal models and are not consistent with control solely by local reflexes. Because the system is unstable, errors in stabilization provide a perturbation which grows into a sway which has to be reacted to and corrected. Sagittal sway results from this impulsive control of calf muscle activity rather than internal sources (e.g., the hear, breathing). This process is quite unlike the mechano-reflex paradigm. We suggest that standing is skilled, trial and error activity that improves the experience and is automated (possibly by the cerebellum). These results compliment and extend our recent demonstration that paradoxical muscle movements are the norm in human standing." Journal of Physiology Vol. 564.1, 2005, p. 295, the entire contents of which is hereby incorporated by reference.

The articles "a" and "an" as used herein in the specification and in the claims, unless clearly indicated to the contrary, should be understood to include the plural referents. Claims or descriptions that include "or" between one or more members of a group are considered satisfied if one, more than one, or all of the group members are present in, employed in, or otherwise relevant to a given product or process unless indicated to the contrary or otherwise evident from the context.

The invention includes embodiments in which exactly one member of the group is present in, employed in, or otherwise relevant to a given product or process. The invention also includes embodiments in which more than one or the entire group of members is present in, employed in or otherwise relevant to a given product or process. Furthermore, it is to be understood that the invention encompasses all variations, combinations, and permutations in which one or more limitations, elements, clauses, descriptive terms, etc., from one or more of the listed claims is introduced into another claim dependent on the same base claim (or, as relevant, any other claim) unless otherwise indicated or unless it would be evident to one of ordinary skill in the art that a contradiction or inconsistency would arise.

Where elements are presented as lists, (e.g., in Markush group or similar format) it is to be understood that each subgroup of the elements is also disclosed, and any element(s) can be removed from the group. It should be understood that, in general, where the invention, or aspects of the invention, is/are referred to as comprising particular elements, features, etc., certain embodiments of the invention or aspects of the invention consist, or consist essentially of, such elements, features, etc. For purposes of simplicity those embodiments have not in every case been specifically set forth in so many words herein. It should also be understood that any embodiment or aspect of the invention can be explicitly excluded from the claims, regardless of whether the specific exclusion is recited in the specification. The entire contents of all of the references (including literature references, issued patents and published patent applications and websites) cited throughout this application are hereby expressly incorporated by reference.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification, embodiments have been described in a way which enables a clear and concise specification to be written, but it is intended and will be appreciated, that embodiments may be variously combined or separated without departing from the invention. It is intended that the present invention be limited only to the extent required by the appended claims and the applicable rules of law.

What is claimed is:

1. A standing step trainer comprising:

a. a planar base configured to support a body weight of a user, wherein the base further comprises a flange member integrally attached to the base, wherein a c-shaped carve out within the flange member is configured to secure a portion of a planar standing plate between a groove within the base and the c-shaped carve out so that the connection between the standing plate and the base forms a fulcrum;

b. a first spring secured to the base, the first spring being positioned along a forefoot axis and located a distance y away from the flange member; and c. the first spring providing a spring rate configured to assist a return of a user's ankle or knee to a more vertical position after the user's center of mass has shifted as a result of plantar flexion or dorsiflexion.

2. The standing step trainer of claim 1 further comprising a second spring wherein:

a. the second spring is secured to the base and is positioned along the forefoot axis; and b. the second spring providing a spring rate configured to assist a return of the user's ankle or knee to a more vertical position after the user's center of mass has shifted as a result of plantar flexion or dorsiflexion.

3. The standing step trainer of claim 2 wherein the distance y is adjustable.

4. The standing step trainer of claim 2 wherein the distance y is about a length of a distance from the user's heel to a beginning of the user's forefoot.

5. The standing step trainer of claim 2 wherein a length of the distance y from the flange member is between 8 cm and 30 cm.

6. The standing step trainer of claim 2 wherein a separation between springs located along the forefoot axis is between the range of 8 cm to 50 cm.

7. The standing step trainer of claim 2 wherein the spring rate is between the range of 20 lbs./in and 110 lbs./in.

8. The standing step trainer of claim 2 wherein an angle formed between the base and the standing plate is about 25 degrees.

9. The standing step trainer of claim 2 wherein the standing plate is further comprised of a cushioned surface.

10. A method for increasing a flow of nitric oxide within a human body as compared with a resting state comprising the steps of:

a. standing on a planar base configured to support a body weight of a user, wherein:

i. the base further comprises a flange member integrally attached to the base, wherein a c-shaped carve out within the flange member is configured to secure a portion of a planar standing plate between a groove within the base and the c-shaped carve out so that the connection between the standing plate and the base forms a fulcrum;

ii. a first spring secured to the base, the first spring being positioned along a forefoot axis and located a distance y away from the flange member; and iii. the first spring providing a spring rate configured to assist a return of a user's ankle or knee to a more vertical position after the user's center of mass has shifted as a result of plantar flexion or dorsiflexion;

b. placing a heel on the standing plate; and c. initiating plantar flexion.

11. The method of claim 10 further comprising a second spring wherein:

a. the second spring is secured to the base and is positioned along the forefoot axis; and b. the second spring providing a spring rate configured to assist a return of the user's ankle or knee to a more vertical position after the user's center of mass has shifted as a result of plantar flexion or dorsiflexion.

12. The method of claim 11 wherein a length of the distance y is adjustable.

13. The method of claim 11 wherein a length of the distance y is about a length of the user's heel to the beginning of the user's forefoot.

14. The method of claim 11 wherein a length of the distance y is between 8 cm and 30 cm.

15. The method of claim 11 wherein a separation between springs located along the forefoot axis is between 8 cm and 50 cm.

16. The method of claim 11 wherein the spring rate is between the range of 20 lbs./in and 110 lbs./in.

17. The method of claim 11 wherein an angle formed between the base and the standing plate is about 25 degrees.

18. The method of claim 11 wherein the standing plate is further comprised of a cushioned surface.

* * * * *